US009000872B2

(12) United States Patent
Franke et al.

(10) Patent No.: US 9,000,872 B2
(45) Date of Patent: Apr. 7, 2015

(54) INFORMATION CARRIER AS WELL AS DEVICE AND METHOD FOR MOUNTING AND REMOVING SUCH AN INFORMATION CARRIER

(75) Inventors: Volker Franke, Petershagen (DE); Volker Huckriede, Roedinghausen (DE); Thomas Heimann, Rahden (DE); Michael Koch, Petershagen (DE)

(73) Assignee: Harting Applied Technologies GmbH, Espelkamp (DE)

( * ) Notice: Subject to any disclaimer, the term of this patent is extended or adjusted under 35 U.S.C. 154(b) by 0 days.

(21) Appl. No.: 13/994,809

(22) PCT Filed: Sep. 9, 2011

(86) PCT No.: PCT/DE2011/001715

§ 371 (c)(1),
(2), (4) Date: Jun. 17, 2013

(87) PCT Pub. No.: WO2012/079554

PCT Pub. Date: Jun. 21, 2012

(65) Prior Publication Data

US 2013/0265126 A1 Oct. 10, 2013

(30) Foreign Application Priority Data

Dec. 15, 2010 (DE) ..... 10 2010 054 562

(51) Int. Cl.

| | |
|---|---|
| ***H01F 7/20*** | (2006.01) |
| ***H01F 7/02*** | (2006.01) |
| ***G09F 7/04*** | (2006.01) |
| *G09F 7/18* | (2006.01) |

(52) U.S. Cl.
CPC .. *H01F 7/02* (2013.01); *G09F 7/04* (2013.01); *G09F 2007/1852* (2013.01)

(58) Field of Classification Search
USPC ..... 335/285–295; 248/206.5, 309.4
See application file for complete search history.

(56) References Cited

U.S. PATENT DOCUMENTS

| | | | | |
|---|---|---|---|---|
| 4,735,006 | A | 4/1988 | Kane | |
| 4,971,278 | A * | 11/1990 | Woods | 248/206.5 |
| 5,065,537 | A | 11/1991 | Bailey | |
| 5,342,726 | A | 8/1994 | Lima-Marques | |
| 6,302,363 | B1 * | 10/2001 | Olson et al. | 248/206.5 |
| 6,957,502 | B2 | 10/2005 | Bedetti | |
| 7,469,869 | B2 * | 12/2008 | Killion | 248/206.5 |
| 2005/0023420 | A1 * | 2/2005 | Sadeh et al. | 248/206.5 |
| 2006/0266914 | A1 | 11/2006 | Killion | |

(Continued)

FOREIGN PATENT DOCUMENTS

| | | |
|---|---|---|
| DE | 8913353 U1 | 12/1989 |
| EP | 1 258 853 | 11/2002 |
| JP | H04-245274 | 9/1992 |

(Continued)

*Primary Examiner* — Bernard Rojas
(74) *Attorney, Agent, or Firm* — Jacobson Holman, PLLC.

(57) ABSTRACT

For an information carrier (1) for magnetically attaching to an object (8) to be marked, according to the invention the information carrier (1) is provided with a contact-breaking surface (4), which is connected to a contact surface (2) of the information carrier (1) at an angle, wherein the contact surface (2) enables the information carrier (1) to magnetically adhere to the object (8) to be marked. By tipping the information carrier (1) onto the contact-breaking surface (4) by means of a corresponding device, the information carrier (1) can be removed from the object (8) to be marked.

10 Claims, 3 Drawing Sheets

(56) References Cited

U.S. PATENT DOCUMENTS

Figure 1:
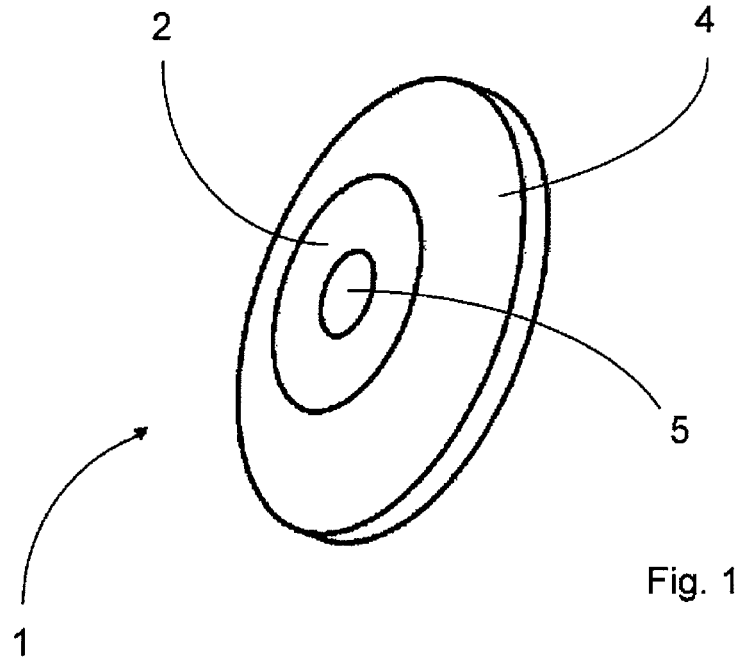

| | | | | |
|---|---|---|---|---|
| 2006/0278779 | A1* | 12/2006 | Killion | 248/206.5 |
| 2007/0194187 | A1* | 8/2007 | Amron | 248/206.5 |

FOREIGN PATENT DOCUMENTS

| | | |
|---|---|---|
| JP | 05-043183 | 2/1993 |
| JP | 7 253754 | 10/1995 |

* cited by examiner

INFORMATION CARRIER AS WELL AS DEVICE AND METHOD FOR MOUNTING AND REMOVING SUCH AN INFORMATION CARRIER

This is a national stage of PCT/DE11/001715 filed Sep. 9, 2011and published in German, which has a priority of German no. 10 2010 054 562.7 filed Dec. 15, 2010, hereby incorporated by reference.

DESCRIPTION

The invention relates to an information carrier to be mounted at an object to be marked, with the information carrier comprising at least one contact area, which contacts by way of magnetic adhesion of the information carrier a surface of the object to be marked, as well as a device and a method for mounting and removing the information carrier.

Such an information carrier is required in order to mark objects or to provide them with information. It shall be possible to reversibly remove the information from the object in order to allow a repeated marking of the object. At the same time, the storage of information on the information carrier is possible in different variants. For example, the information may be stored on the information carrier optically in the form of letters, signs, colors, or barcodes, but also in an electronic form via RFID.

OBJECTIVE

The invention is based on the objective to embody an information carrier such that the information carrier can be fastened on an object without any human intervention via a simple mechanical device, as well as can be removed from said object via a simple mechanical device.

This objective is attained such that the information carrier comprises a carrier area approximately parallel in reference to the contact area, that the information carrier comprises a decontacting area following the contact area, which is inclined away from the surface of the object to be marked and forms an angle $\alpha$ with it, and that the information carrier via a respective device can be mounted on the surface of the object to be marked and can be removed therefrom.

Advantageous embodiments of the invention are disclosed in the dependent claims.

The invention relates to an information carrier suitable to store information and be temporarily mounted to an object. The information may be stored as well in different forms on the information carrier. For example a simple optic marking by way of a colored design of the information carrier is possible. An illustration of information on the information carrier can also occur by displaying information by way of writing letters and numbers or other symbols on the information carrier. Stored data in the form of barcodes on the information carrier are possible as well.

In addition to the option for storing information for an optic detection on an information carrier there are also electronic options for storing information on an information carrier. In a preferred embodiment the application of a RFID-tag on or in the information carrier allows the option of a touch-less detection of stored data.

According to the invention the application of the information carrier at the object to be marked occurs via magnetic adhesion. For this purpose it is necessary that the object to be marked is made at least partially from a material that can be magnetized. By at least one magnet located in the information carrier a magnetic force develops acting between the information carrier and the object to be marked. Therefore a magnetic adhesion of the information carrier is possible at the object to be marked.

In a beneficial embodiment the information carrier calls for a contact area, at which the information carrier can be contacted at a surface of the object to be marked. The magnet located in the information carrier develops a magnetic field at the contact area of the information carrier, which allows a magnetic adhesion at the contact area.

According to the invention the information carrier calls for another surface, which is parallel in reference to the contact area and extends at the opposite side of the information carrier. Similar to the contact area, a magnetic field is also given at the carrier area, which develops by the magnet located in the information carrier.

In a particular embodiment the magnetic field strength at the contact area is greater than the magnetic field strength at the carrier area. This difference in the magnetic field strengths at the two areas can be generated by an appropriate positioning of the magnet in the information carrier. In this way, a positioning of the magnet is possible not at the central line between the two areas but closer to the contact area.

In an advantageous further development several magnets are integrated in the information carrier, with stronger or several magnets being arranged in the proximity of the contact area and weaker or fewer magnets in the proximity of the carrier area. By this further development the different magnetic field strengths according to the invention can be generated at the contact area and the carrier area.

According to the invention the information carrier also calls for, in addition to the contact area and the carrier area, a decontacting area. The decontacting area follows the contact surface at an angle and here approaches the carrier area. The magnets in the information carrier are to be arranged such that the magnetic field strength is lower at the decontacting area than the magnetic field strength at the carrier area.

In order to mount and remove the information carrier at an object to be marked a device is provided, by which a simple mounting and removal is possible. The device shows a carrier element embodied such that the carrier area of the information carrier can be brought into contact with the carrier element in a planar fashion. In addition, the carrier element of the device is made at least partially from a material that can be magnetized, with the magnetic field at the carrier area of the information carrier allowing an adhesion due to the magnetic attraction between the information carrier and the carrier element.

In one embodiment according to the invention the carrier element is fastened at the device in a movable fashion. It is provided for that the carrier element can be tilted, for example about the angle formed by the decontacting area of the information carrier with the surface of the object to be marked, at which the information carrier adheres magnetically.

By means of the device, a mounting of the information carrier is possible at an object to be marked. For this purpose, the information carrier adheres with its carrier surface at the carrier element of the device by a magnetic force resulting from the magnetic field at the carrier area. The device is moved with the adhering information carrier to the object to be marked until the contract area of the information carrier contacts the surface of the object to be marked. The magnetic field at the contact area of the information carrier causes a magnetic attraction between the information carrier and the surface of the object to be marked. Due to the differences in the magnetic field strengths at the carrier area and the contact area of the information carrier the magnetic force resulting between the information carrier and the object is greater than the magnetic force resulting between the information carrier and the device. With a motion of the device away from the object to be marked the information carrier remains magnetically mounted to the object to be marked.

In a particular embodiment the carrier element of the device consists of two different elements. The frontal individual element, being in a direct contact to the carrier area of the information carrier, is here embodied as a plate and consists of a material, which cannot be magnetized; for example, plastic. The second individual element arranged directly behind it consists of a material, which can be magnetized, and is fastened at the first individual element in a manner that it can be pivoted away. The first individual element shall be embodied so thinly that upon the carrier area of the information carrier contacting the first individual element a magnetic interaction with the second individual element is not prevented.

During the mounting process of the information carrier at the object to be marked, after the carrier area contacting the second carrier element, the second individual element is pivoted away from the first individual element. By the greater distance developing here between the information carrier and the individual element of the carrier element that can be magnetized the magnetic force reduces between the information carrier and the carrier element. This way, a removal of the device from the object to be marked is possible, with the information carrier remaining magnetically at the surface of the object to be marked.

In order to remove the information carrier from the object to be marked the carrier element is tilted at the device. Here the tilting angle is approximately equivalent to the angle formed by the decontacting area with the contact area, however in the opposite rotary direction. The device with the tilted carrier element is then moved towards the information carrier at the object to be marked until the carrier element contacts the carrier area of the information carrier in the area of the decontacting area. By a further approach of the carrier element to the object to be marked the carrier element causes via a lever effect the information carrier to be tilted opposite the magnetic force on the contact surface so that, instead of the contact area, the decontacting area contacts the surface of the object to be marked. During the same process the carrier area of the information carrier contacts the carrier element. Based on the differences in the magnetic field strength at the decontacting area and the contact area of the information carrier the resulting magnetic force between the information carrier and the carrier element is greater than the magnetic force resulting between the information carrier and the object to be marked. When moving the device away from the object to be marked the information carrier remains magnetically adhered at the carrier element and can be removed from the object to be marked.

In another embodiment it may be provided for to form the decontacting area as an annular, elliptic, or hyperbolic rounding connected to the contact area. This way the carrier area of the information carrier is brought into contact with the carrier element during the removal of the object to be marked, instead via a tilting motion, by a rolling motion of the information carrier on the decontacting area.

In a beneficial embodiment the information carrier is embodied as a round disk, with its front representing the contact area and the back the carrier area. The decontacting area is embodied as a circumferential bevel at the contact area. This embodiment is primarily beneficial because the orientation of the information carrier and thus the decontacting area is irrelevant for the mounting to and removal from the object to be marked.

Polygons represent additional beneficial embodiments of the information carrier. Here, the decontacting area may be embodied as a round circumferential bevel, so that the contact area forms a circle, or the decontacting area may be embodied as individual bevels at each segment of the polygon so that the contact area shows a form according to the polygon.

Additional embodiments of the invention are described in the dependent claims.

EXEMPLARY EMBODIMENT

Figure 2:
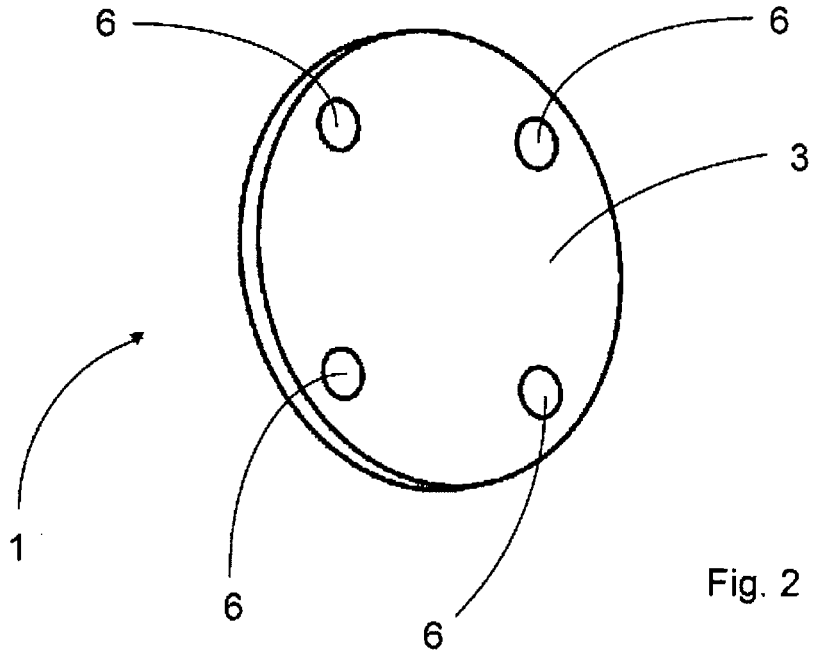
Figure 3D:
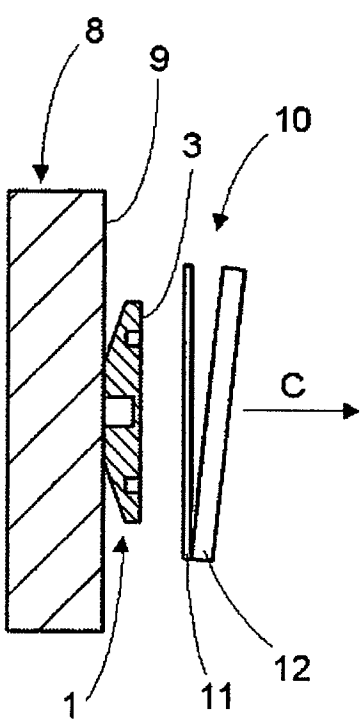
Figure 3C:
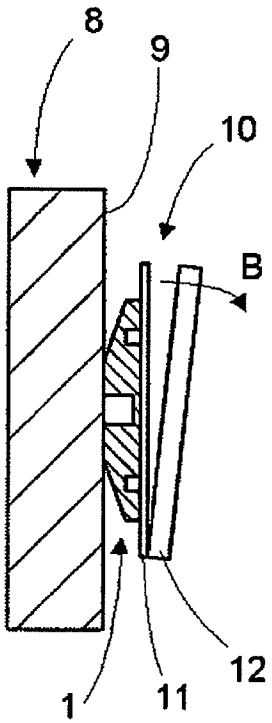
Figure 3B:
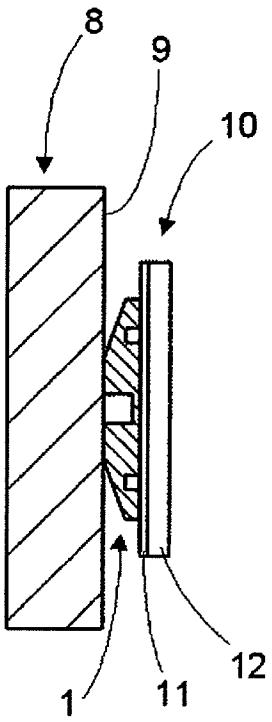
Figure 3A:
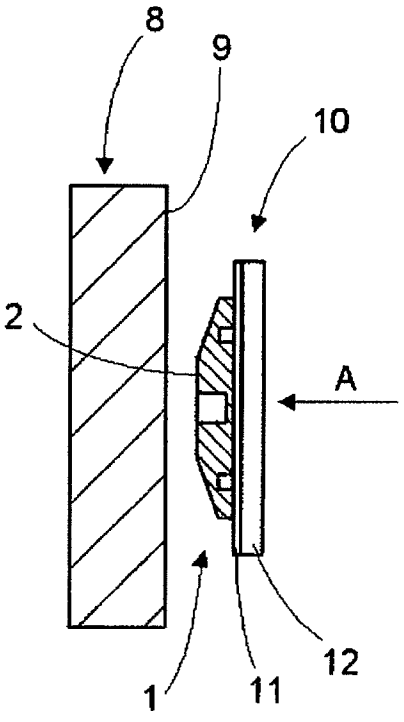
Figure 4C:
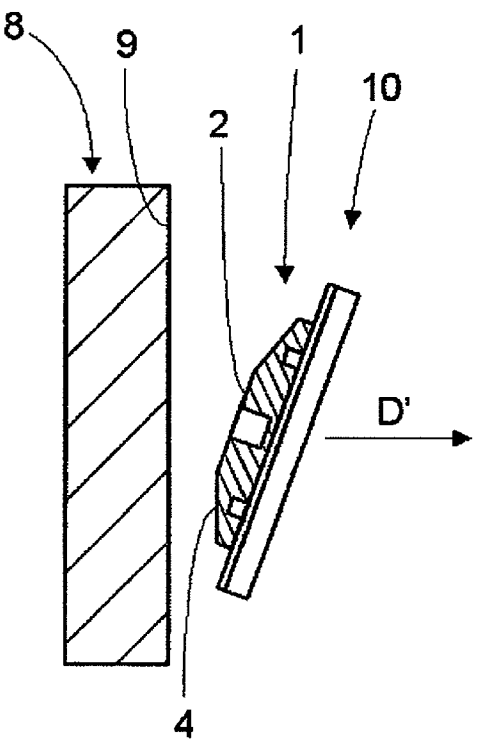
Figure 4B:
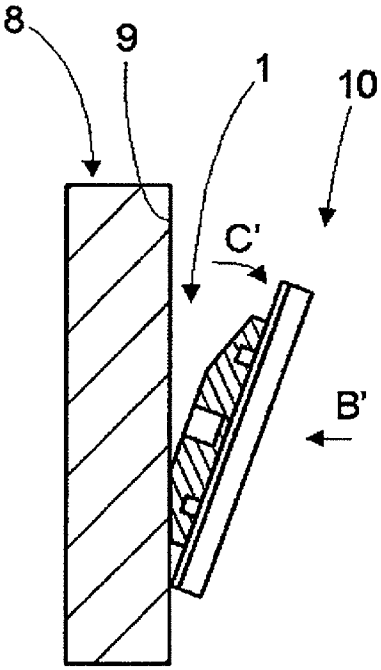
Figure 4A:
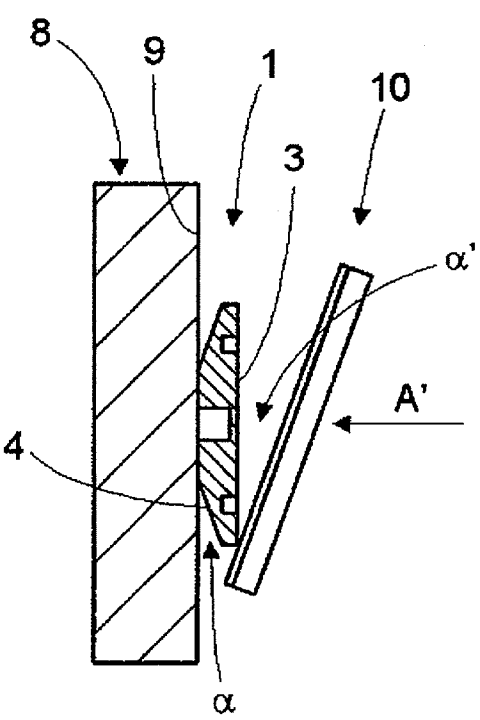

The drawing shows an exemplary embodiment of the invention, which is explained in greater detail in the following. It shows:

FIG. 1 an information carrier in a spatial view;

FIG. 2 an information carrier in a spatial view;

FIG. 3*a* the mounting process of an information carrier on an object in a cross-sectional illustration;

FIG. 3*b* the mounting process of the information carrier on an object in a cross-sectional illustration;

FIG. 3*c* the mounting process of the information carrier on an object in a cross-sectional illustration;

FIG. 3*d* the mounting process of the information carrier on an object in a cross-sectional illustration;

FIG. 4*a* the removal process of the information carrier from an object in a cross-sectional illustration;

FIG. 4*b* the removal process of the information carrier from an object in a cross-sectional illustration; and FIG. 4*c* the removal process of the information carrier from an object in a cross-sectional illustration.

FIG. 1 shows an information carrier 1 in a spatial illustration. The information carrier embodied as a disk calls for a contact area 2, which is provided for contacting an object to be marked. A magnet 5 is integrated in the contact area 2. The magnet 5 causes an attractive force between the information carrier and the object to be marked. A decontacting area 4 follows the contact area 2 circumferential at the edge of the disk-shaped information carrier 1. The ability to remove the information carrier 1 from an object to be marked is provided for.

FIG. 2 shows the information carrier 1 in a spatial illustration, however from the side facing away from the contact area 2. The back of the disc-shaped information carrier is discernible, which forms a carrier area 3. The carrier area 3 is provided with a device for an optional mounting to or removal from the information carrier in order for the information carrier 1 contacting a carrier element 10 of a device. In the carrier area 3 here four magnets 6 are integrated, which allow a magnetic adhesion of the information carrier 1 at the carrier element 10.

FIGS. 3*a* to 3*d* show the mounting process of the information carrier 1 at a surface 9 of the object 8 to be marked. Here, the respective object 8 to be marked is discernible, with the object 8 at least partially being made from a material which can be magnetized, the information carrier 1, as well as the carrier element 10 of the device for an optional mounting to or removal from the information carrier.

In FIG. 3*a* the carrier element 10 is shown in front of the surface 9, arranged at a device to mount or remove the information carrier. The carrier element 10 consists of a first individual element 11, which is made from a material that cannot be magnetized, and a second individual element 12, which is made from a material that can be magnetized.

The information carrier 1 adheres at the carrier element 10 by way of magnetic attraction upon the second individual element 12. Here, the information carrier 1 contacts the first individual element 11 of the carrier element 10 with the carrier area 3. The contact area 2 is arranged parallel in reference to the surface 9 of the object 8 to be marked. A represents the direction of motion of the carrier element 10 with the information carrier 1 adhering thereto.

FIG. 3*b* shows the contacting of the contact area 2 of the information carrier 1 with the surface 9 of the object 8 to be marked. The magnets integrated in the information carrier generate a magnetic force both on the carrier element 12 as well as on the object 8.

In FIG. 3*c*, B represents a folding motion of the second individual element 12, away from the first individual element 11. By the greater distance between the second individual element 12 and the information carrier 1 generated here the magnetic attractive force diminishes between the information carrier 1 and the carrier element 10.

The movement C of the carrier element 10 away from the object 8 to be marked is shown in FIG. 3*d*. Here, the information carrier 1 remains at the surface 9, because the magnetic attractive force between the information carrier 1 and the object 8 to be marked is greater than the attractive force between the information carrier 1 and the second individual element 12 folded away.

FIGS. 4*a* to 4*c* represent the removal process of the information carrier 1 from the surface 9 of the object 8 to be marked. The object 8 to be marked is respectively shown, the information carrier 1, as well as the carrier element 10 of the device for an optional mounting or removal of the information carrier.

In FIG. 4*a* the information carrier 1 adheres with the contact area 2 at the surface 9 of the object 8 to be marked in a magnetic fashion. The carrier element 10 is moved at the side of the carrier area 3 of the information carrier 1 in the direction A' until reaching the information carrier 1. The carrier element 10 is here tilted by the angle $\alpha'$, with the angle $\alpha'$ being approximately equivalent to the angle $\alpha$, which is formed by the decontacting area 4 with the surface 9 of the object 8 to be marked, although in the opposite direction.

By another motion B' of the carrier element 10 in the direction of the information carrier 1 the carrier element 10 applies a force upon the carrier surface 3 in the area of the decontacting area 4. The lever force developing here upon the information carrier 1 takes place about the edge, which is combined from the contact area 2 and the decontacting area 4. The lever force causes a tilting motion C' of the information carrier 1 about said edge, so that the angle $\alpha$ and $\alpha'$ become smaller. The motion B' of the carrier element is continued until the decontacting area 4 comes into contact with the surface 9 of the object 8 to be marked and the carrier surface 3 contacts the carrier element 10.

According to the invention, due to the differences in magnetic field strength at the carrier surface 3 between the information carrier 1 and the carrier element 10 the magnetic attractive force is greater than the magnetic force at the decontacting area 4 between the information carrier 1 and the object 8 to be marked.

The motion D' of the carrier element 10 away from the object 8 to be marked is shown in FIG. 4*c*. Here, the information carrier 1 remains magnetically adhered to the carrier element 10 and is therefore removed from the surface 9 of the object 8 to be marked.

LIST OF REFERENCE CHARACTERS

Information Carrier as well as Device and Method for Assembling and Disassembling such an Information Carrier

1 Information carrier
2 Contact area
3 Carrier area
4 Decontacting area
5 Magnet
6 Magnet
8 Object
9 Surface
10 Carrier element
11 First individual element/cannot be magnetized
12 Second individual element/can be magnetized

The invention claimed is:

1. An information carrier to be mounted at an object to be marked, said information carrier comprising first and second opposed surfaces, said first surface including a magnet for mounting said information carrier to said object to be marked by a magnetic attraction therebetween, at least one planar contact area surrounding the magnet for contacting a surface of the object to be marked when the information carrier is mounted thereon, and a decontacting area surrounding the planar contact area, which forms an angle a with the planar contact area, said second surface comprising means for receiving and retaining a carrier element for mounting and removing the information carrier to the object to be marked, said means including a planar carrier surface suitable for magnetic adhesion.

2. An information carrier according to claim 1, wherein the magnetic field strength of said magnet is greater at the planar contact area than the magnetic field strength at the planar carrier surface, and that the magnetic field strength at the planar carrier surface is greater than the magnetic field strength at the decontacting area.

3. An information carrier according to claim 1, wherein said information carrier includes several magnets,

4. An information carrier according to claim 1, wherein said information carrier is embodied as a round disk, and that the decontacting area extends circumferentially along an edge of the planar contact area.

5. An information carrier according to claim 1, wherein said information carrier is embodied as a polygonal disk, and that the decontacting area extends circumferentially along an edge of the planar contact area.

6. An information carrier according to claim 1, wherein said decontacting area is embodied with regards to a perpendicular cross-section along the diameter of the information carrier as a circular, elliptic, or hyperbolic rounding following the planar contact area.

7. A method for mounting an information carrier to an object surface via a carrier element, wherein said information carrier has a contact area for contacting said object surface and is magnetically adherable to said object surface, said information carrier further having a carrier element area for contacting said carrier element and is magnetically adhered to said carrier element, wherein the magnetic attractive force between the information carrier and the object surface is greater than the magnetic attractive force between the information carrier and the carrier element, wherein the mounting method comprises moving the information carrier and the carrier element that is magnetically adhered thereto to said object surface so as to adhere the information carrier to the object surface, and then removing the carrier element from the information carrier which remains on the object surface.

8. A method for mounting an information carrier according to claim 7, wherein said carrier element includes first and second individual elements adjacent to each other and pivotable with respect to each other, said method comprising pivoting the second individual element away from the first individual element, thus reducing the magnetic attractive force between the information carrier and the carrier element (10).

9. A device for the mounting or removal of an information carrier to an object, said information carrier having a magnetically adherable planar carrier area, said device comprising a planar carrier element for magnetically adhering to the planar carrier area of the information carrier, wherein. said planar carrier element comprises two individual planar elements arranged behind each other, with the first individual planar element directly contacting the planar carrier area of the information carrier and comprising a material that cannot be magnetized, and with the second individual planar element located adjacent and behind the first individual planar element and comprising a material that can be magnetized, wherein the second individual planar element can be pivoted away from the first individual planar element.

10. A method for removing an information carrier from an object surface via a carrier element, wherein said information carrier is magnetically adhered to said object surface and includes a decontacting area that is inclined at an angle $\propto$ with respect to said object surface, said information carrier further including a planar carrier area for contacting and magnetically adhering to said carrier element, wherein the removing method comprises moving the carrier element toward and in contact with the planar carrier area at an angle of approximately $\propto$, tilting the information carrier such that the angle $\propto$ between the decontacting area and the object surface diminishes until the planar carrier area of the information carrier contacts the carrier element, whereby the magnetic attractive force between the information carrier and the carrier element is greater than the magnetic attractive force between the information carrier and the object, and then moving the carrier element away from the object with the information carrier remaining magnetically adhered to the carrier element and removed from the object.

* * * * *